US007001056B2

(12) United States Patent
Clegg

(10) Patent No.: US 7,001,056 B2
(45) Date of Patent: Feb. 21, 2006

(54) LED ILLUMINATED PENDANT

(76) Inventor: Tim Clegg, 19220 S. Normandie Ave., Torrance, CA (US) 90502-1011

( * ) Notice: Subject to any disclaimer, the term of this patent is extended or adjusted under 35 U.S.C. 154(b) by 67 days.

(21) Appl. No.: 10/775,777

(22) Filed: Feb. 7, 2004

(65) Prior Publication Data

US 2005/0174800 A1 Aug. 11, 2005

(51) Int. Cl.
*A44C 1/00* (2006.01)

(52) U.S. Cl. ..... 362/571; 362/104; 63/1.11; 63/1.13

(58) Field of Classification Search ..... 362/104, 362/571; 63/1.11, 1.12, 1.13
See application file for complete search history.

(56) References Cited

U.S. PATENT DOCUMENTS

| | | | | |
|---|---|---|---|---|
| 6,233,971 | B1 * | 5/2001 | Ohlund | 63/3 |
| 6,626,009 | B1 * | 9/2003 | Ohlund | 63/3.1 |
| 2002/0089859 | A1 * | 7/2002 | Jackson et al. | 362/571 |

* cited by examiner

*Primary Examiner*—Stephen Husar
*Assistant Examiner*—Meghan K. Dunwiddie
(74) *Attorney, Agent, or Firm*—Clement Cheng

(57) ABSTRACT

An LED illuminated pendant comprises a necklace formed of strands having a pair of electrical wires of positive and negative polarity. A barrel housing, a printed circuit board and a pendant lit by an LED element are mounted on the pendant. The strand joins to the barrel housing, and the barrel housing forms a housing connector at its end. The barrel houses a battery cage. The battery cage holds a plurality of batteries and electrical wires disposed within the first strand.

11 Claims, 2 Drawing Sheets

LED ILLUMINATED PENDANT

DISCUSSION OF RELATED ART

Illuminated jewelry has been disclosed as early as in U.S. Pat. No. Des. 251,629; U.S. Pat. Nos. 3,450,872; 3,689,758; and 4,101,955. Since then, a wide variety of illuminated necklaces have been invented and introduced into the marketplace. An illuminated necklace pendant is described by Murphy U.S. Pat. No. 4,262,324 and Kamara U.S. Pat. No. 6,601,965 including a battery held in a clasp held behind a neck of a user.

The battery is commonly stored behind the neck in the battery case. Ohlund U.S. Pat. No. 6,122,933 shows a light emitting diode powered upon insertion of conductive wire into the battery chamber. Unfortunately, the separation of the circuit around a person's neck makes the construction cumbersome and overly complicated.

Ohlund U.S. Pat. No. 5,477,433 provides intermittent illumination by intermittent electrical connection between the plurality of interlocking separate chain elements comprising the illuminated necklace. Other illuminated necklaces retained the clasp by opposing magnetic elements.

FIELD OF INVENTION

The present invention is a lighted necklace with pendant.

BRIEF DESCRIPTION OF THE DRAWINGS

FIG. one is a front plain view of a LED illuminated pendant.

FIG. two is a perspective side view of a LED illuminated pendant.

CALL OUT LIST OF ELEMENTS

11 Bottom End
12 Lid
14 Square Steps
21 Battery
22 First Electrical Cord
23 Second Electrical Cord
24 Spring
44 Metal Clip
46 Dimpled Middle
48 Top Battery Cage Rim
49 Battery Cage
50 First Strand
61 L Shaped Slot(s)
62 Barrel Housing Connector
63 Second Strand Connector
65 Knot
66 Pinhole
67 Barrel Shaped Battery Camber
69 Mini Printed Circuit Board
80 Button
88 Light Emitting Diode
90 Second Strand
99 Top End
120 Plastic Transparent Pendant

DESCRIPTION OF THE PREFERRED EMBODIMENT

Figure 1:
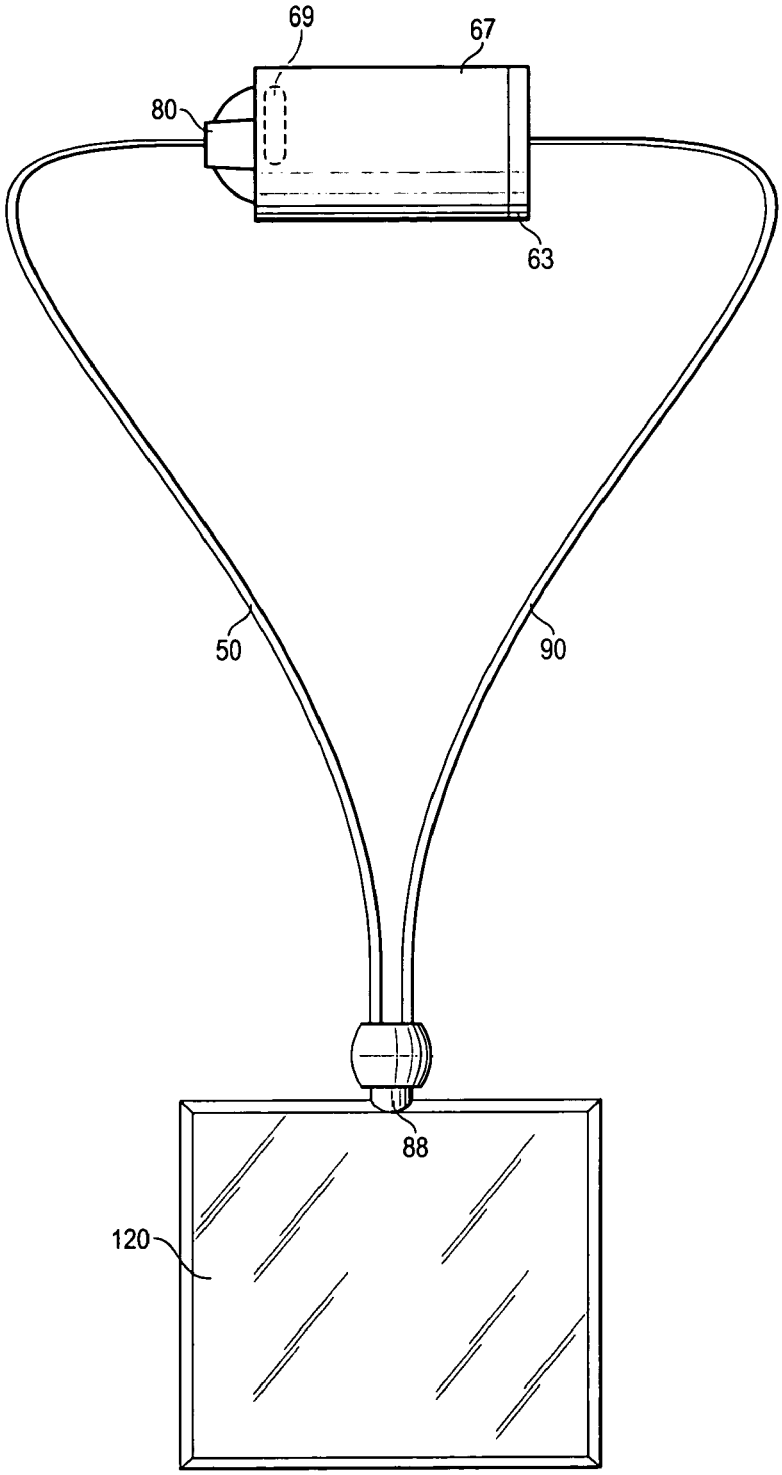

The present invention is a lighted necklace with pendant. FIG. 1.

The pendant is formed as a light emitting diode 88 fixed on a plastic transparent pendant 120. The plastic transparent part 120 is preferably formed as a planar rectangular shape although other shapes and forms are easily prepared and manufactured through injection molding. The surface is preferably flat allowing screen printing or laser inscription on the surface of the plastic pendant. The light emitting diode illuminates advertising or logos printed on the surface of the pendant 120.

Figure 2:
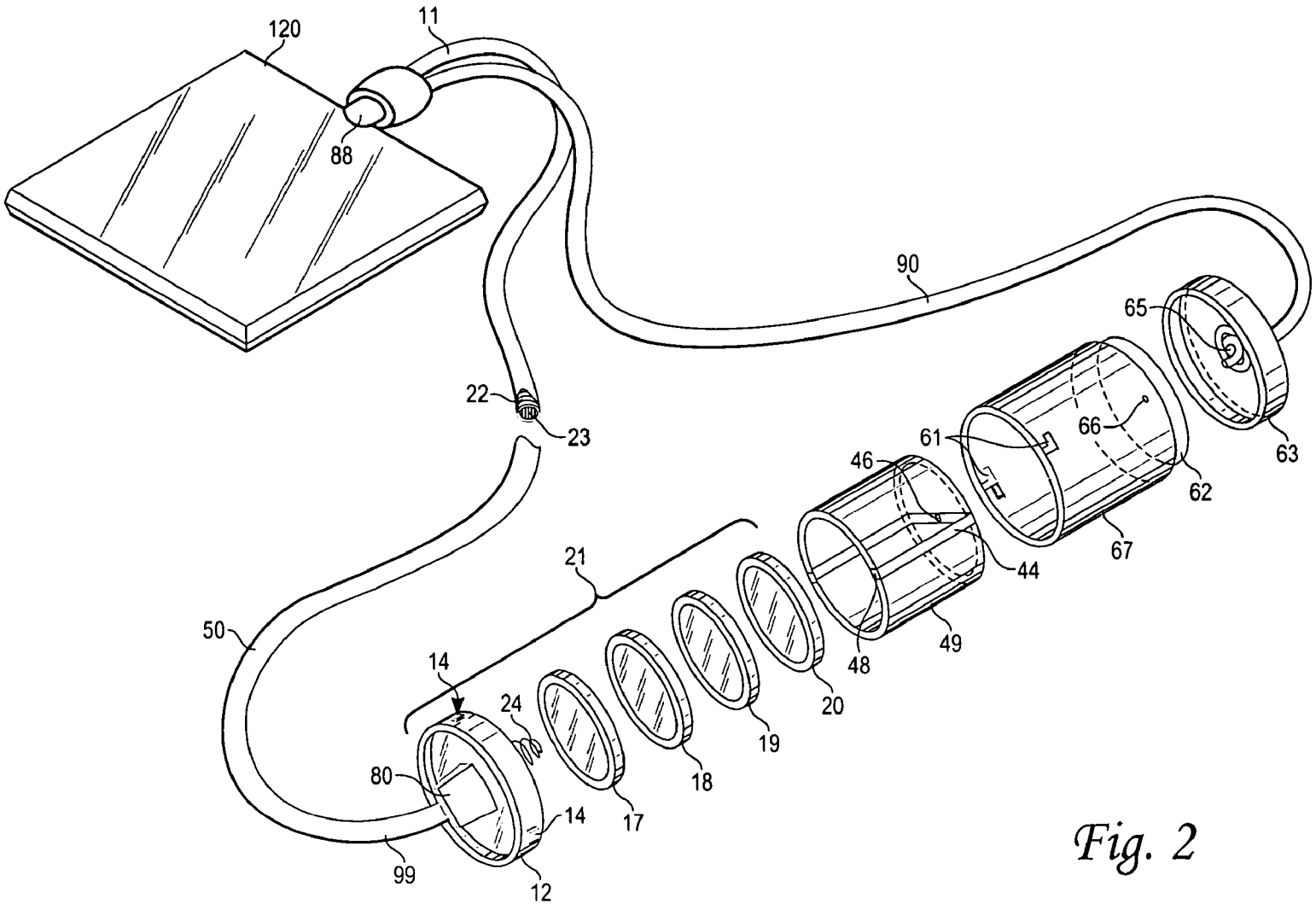

FIG. 2, The first 22 and second 23 electrical cord held in the first strand 50 provide electricity from the battery 21 housed in the barrel to the pendant. The cylindrical shape battery housing can also be called a barrel housing as it resembles a barrel 67. The battery housing 67 can be made of other shapes. The lighted necklace with pendant has a barrel shaped battery chamber 67 having a first electrical cord traveling to the lighted pendant. The second electrical cord is installed in the same strand as the first electrical cord. A second strand 90 connecting to a first strand 50 at the clasp forms a continuous necklace loop wearable by a user. The circuit travels only on the left or right side of a user. The circuit electricity does not travel around the neck of a user.

The first strand 50 has a top end 99 and a bottom end 11. The top end 99 is worn higher than the bottom end 11. The top end 99 of the first strand 50 and the top end of the second strand meet at the barrel behind the neck. The bottom end 11 of the first strand 50 and the bottom end of the second strand meet at the pendant commonly placed at the breast of a wearer.

The second strand 90 does not have current flowing through it when the necklace pendant is lit but provides the same mechanical support. The second strand 90 appears like the first strand such that a casual observer does not see a stylistic difference between the first strand 50 and the second strand 90. The first strand 50 is preferably an electrical cord carrying a pair of positive and negative wires within the cord. A transparent plastic sheath may envelop copper wires. The wires are commonly enveloped within plastic insulation. The cord is commonly enveloped again within plastic insulation.

The second strand 90 can also comprise an electrical cord carrying a pair of positive and negative wires within the cord. The wires within the second strand 90 can also be enveloped within plastic insulation. The wires within the cord in the second strand 90 can also be enveloped again within plastic insulation. The plastic insulation for the first strand 50 and the second strand match in degree of transparency so that they have the same transparency. The plastic insulation for the first 50 and second strand match in color so that they have the same color. The second strand does not receive an electrical connector cable of providing electrical voltage to either one of the positive or negative wires within the second strand.

The electrical connector is not present within this invention. The second strand can be used, as a replacement for the first strand should the first strand 50 become cut or damaged. A user may disassemble the device and use solder to remove the first strand 50 from electrical connection so that the user may replace the second strand 90 for the first strand 50. Because the item is inexpensive most users may choose to discard the device. In any case, the second strand 90 is made of the same material and appears to be the same as the first strand 50.

Preferably, the push button 80 appears on the connection between the first strand and the barrel housing. A clasp connection formed on the barrel housing disconnects and connects with the clasp connection on the second strand. The second strand retains the second strand clasp connector. The second strand clasp connector forms a small aperture allowing the second strand to protrude through the aperture. The second strand has a knot 65 tied upon the second strand and retains the connector because the knot 65 is larger than the small aperture. The granny knot 65 is a possible knot 65 for forming a retaining means. It is also possible to heat form or glue the second strand connector 63 to the top end portion of the second strand.

The second strand connector 63 is capable of connecting to the barrel housing connector 62. The barrel housing has a connector formed on the housing shaped to receive the second strand connector.

The barrel connection portion can form a shallow cylindrical protrusion 62 receiving a shallow cylindrical depression formed on the second strand connector 63. Although a cylindrical male piece fitting within a female cylindrical depression is preferred, other configurations are obviously possible. For example, a flat portion of opposing hook and loop tape surfaces can be implemented between the barrel connection portion and the second strand connector. Interference fit, hook and loop tape or magnetic attraction can retain the connection between the barrel connector and the second strand connector.

The push button 80 can also appear on the connection between the second strand and the barrel housing. When the button appears near the second strand, the button can be placed to activate when the clasp connection of the second strand engages with the clasp connection of the first strand.

The barrel contains a push button 80 connected to a switch. The switch is preferably a push button 80 allowing a user to press the button to activate the switch that activates a circuit selector. The circuit selector rotates in selection from a first mode to a second mode to a third mode. The first mode is a slow flash that activates when the user first presses the push button 80 to turn on the device. The second mode is a fast flash that activates when the user presses the push button 80 when the device is in the first mode. The third mode is a continuous on that activates when the user presses the push button 80 when the device is in the second mode. A fourth mode can be the off mode.

A small circuit board houses an integrated circuit allowing mode selection. The printed circuit board controls battery activity according to a switch mode activated by a switch. The barrel housing retains the push button, the small circuit board and the batteries. Preferably, three 1.5 V 17, 18, 19 or four button 17, 18, 19, 20 batteries power the necklace pendant light. The spring 24 enables a variable number battery chamber by deforming to take slack space. The light is formed as an LED.

The barrel storage can be formed of plastic transparent material allowing a user to view the batteries and circuit board enclosed within the barrel storage housing. The barrel housing comprises a barrel portion and a lid 12 portion. The lid 12 portion retains a printed circuit board having a switch and a connection soldered to the electrical wire powering the light element. The lid 12 secures to the barrel portion allowing the user to retain the lid 12 in the barrel. The printed circuit board is preferably formed as a circular planar member fitting within the lid 12 of the barrel housing. Electrical contacts can be formed on both sides of the mini printed circuit board 69 allowing connection between the batteries and the mini printed circuit board 69, FIG. 1, and allowing connection between the light emitting diode and the printed circuit board.

The batteries are held within the battery cage 49 that is a retaining housing for button batteries. The battery cage 49 holds three batteries in series configuration one stacked on top of the other such that electrical and mechanical connection is made between the positive and negative top and bottom contact of the button batteries. The battery cage 49 slides within the barrel housing. The battery cage 49 fits loosely within the barrel shaped battery housing allowing quick removal of the batteries. The battery cage 49 continues to hold the batteries together in the cage after the batteries are removed from the barrel shaped battery housing. The battery cage 49 can be removed from the barrel housing allowing a user to remove all batteries simultaneously.

Along a side of the battery cage 49 the conductive member makes contact with the bottom face of the bottom battery and makes contact with the top rim 48 of the battery cage 49. The conductive member makes electrical connection between the bottom face of the bottom battery and the top rim 48 of the battery cage 49.

The lid 12 has an electrical contact coming into connection with the electrical contact at the top rim 48 of the battery cage 49. The rim connection 48 can be polarized as positive or negative. The lid 12 further contains a spring 24 mounted in the center of the lid 12 that is polarized opposite from the rim polarity 48.

There are many methods of implementing a battery cage. For example, a metal clip 44 formed as a folded strip of conductive metal 44 having a dimpled middle 46 and a pair of ends can be secured around a plastic cylinder that has open top and bottom ends. The metal clip 44 secures the bottom of the plastic cylinder at its middle and the pair of ends extends along the side of the plastic cylinder to the top of the plastic cylinder. The pair ends extend over the top of the plastic cylinder and folds toward the center of the plastic cylinder 49 allowing partial blockage of the plurality of button batteries 17, 18, 19, 20 collectively one battery 21. The partial blockage prevents the button batteries 17, 18, 19, 20 from dropping out of the cage when a user removes the battery cage 49 from the barrel housing.

The lid 12 secures to the barrel housing. The lid 12 has a pair of opposing protrusions formed as square steps 14. The steps 14 fit into respective L shaped slot(s) 61 mounted inside the barrel housing. The steps 14 can be turned along the circumference of the barrel housing allowing the steps to be screwed into the top of the barrel housing. The spring attached to the lid 12 pushes between the battery and lid 12 creating force keeping the lid 12 closed.

A pinhole 66 formed in the bottom of the barrel housing is positioned allowing the user to insert a ball point pen or similar pointed implement for freeing the battery cage 49 should the battery cage 49 become lodged within the barrel housing. The bottom of the barrel housing is the same location where the top end of the second strand attaches to the barrel housing. The pinhole is preferably formed in the center of the barrel housing bottom allowing a user to bias the battery cage 49 from the center of the barrel housing bottom.

When the push button 80 is depressed, a user can activate one or more light elements 88 mounted on the light pendant. The pendant 120 can be formed of three-dimensional laser etched plastic or crystal allowing the viewing of three-dimensional shapes inscribed within the pendant.

The inventiom claimed is:

1. An LED illuminated pendant comprising: a necklace formed of a first strand having a pair of electrical wires of positive and negative polarity disposed within the first strand: a second strand; a barrel housing; a printed circuit board and a pendant lit by an LED element mounted on the pendant; wherein the first strand joins to the barrel housing, the barrel housing forming a housing connector at its end, the second strand attached to a second strand connector, the second strand connector removably joins to the housing connector, the pendant attached to the first strand and the second strand, the barrel housing holding a battery cage, the battery cage holding a plurality of batteries, electrical wires disposed within first strand provide electricity to the LED mounted in the pendant from the plurality of batteries in the battery cage when a switch completes the circuit beginning from the battery to the printed circuit board to the selector switch to the negative polarity first strand electrical wire to the LED to the positive polarity first strand electrical wire to the printed circuit board to the battery, wherein, the barrel connection portion can form a shallow cylindrical protrusion receiving a shallow cylindrical depression formed on the second strand connector.

2. An LED illuminated pendant comprising: a necklace formed of a first strand having a pair of electrical wires of positive and negative polarity disposed within the first strand: a second strand; a barrel housing a printed circuit board and a pendant lit by an LED element mounted on the pendant; wherein the first strand joins to the barrel housing, the barrel housing forming a housing connector at its end, the second strand attached to a second strand connector, the second strand connector removably joins to the housing connector, the pendant attached to the first strand and the second strand, the barrel housing holding a battery cage, the battery cage holding a plurality of batteries, electrical wires disposed within first strand provide electricity to the LED mounted in the pendant from the plurality of batteries in the battery cage when a switch completes the circuit beginning from the battery to the printed circuit board to the selector switch to the negative polarity first strand electrical wire to the LED to the positive polarity first strand electrical wire to the printed circuit board to the battery, wherein, the printed circuit board allows multiple LED modes to allow rotation in mode selection from a first mode to a second mode to a third mode to an off mode.

3. An LED illuminated pendant comprising: a necklace formed of a first strand having a pair of electrical wires of positive and negative polarity disposed within the first strand; a second strand; a barrel housing; a printed circuit board and a pendant lit by an LED element mounted on the pendant; wherein the first strand joins to the barrel housing, the barrel housing forming a housing connector at its end, the second strand attached to a second strand connector, the second strand connector removably joins to the housing connector, the pendant attached to the first strand and the second strand, the barrel housing holding a battery cage, the battery cage holding a plurality of batteries, electrical wires disposed within first strand provide electricity to the LED mounted in the pendant from the plurality of batteries in the battery cage when a switch completes the circuit beginning from the battery to the printed circuit board to the selector switch to the negative polarity first strand electrical wire to the LED to the positive polarity first strand electrical wire to the printed circuit board to the battery, wherein, the battery cage comprises a metal clip having a middle and a pair of ends secured around a plastic cylinder that has open top and bottom ends, wherein the metal clip secures the bottom of the plastic cylinder at its middle and the pair of ends extend along the side of the plastic cylinder to the top of the plastic cylinder, wherein the pair ends extend over the top of the plastic cylinder.

4. The LED illuminated pendant of claim 3 wherein, the barrel connection portion can form a shallow cylindrical protrusion receiving a shallow cylindrical depression formed on the second strand connector.

5. The LED illuminated pendant of claim 3 wherein, the printed circuit board allows multiple LED modes to allow rotation in mode selection from a first mode to a second mode to a third mode to an off mode.

6. The LED illuminated pendant of claim 5 wherein, the first mode is a slow flash that activates when the user first presses the push button to turn on the device, the second mode is a fast flash that activates when the user presses the push button and the third mode is a constant on.

7. The LED illuminated pendant of claim 3 wherein, the lid secures to the barrel housing by a pair of opposing square steps that fit and lock into a pair of respective L shaped slots formed inside the barrel housing, wherein a spring attached to the lid pushes between the battery and lid biasing the lid in closed position.

8. An LED illuminated pendant comprising: an LED lighted pendant element held by a first strand and a second strand; a battery housing forming a housing connector at a first end, the first strand attached to the battery housing, the first strand having a pair of electrical wires of positive and negative polarity disposed within: the second strand attached to the second strand connector that removably joins to the housing connector; a printed circuit board controlling LED activation according to a switch mode activated by a push switch; the battery housing holding a battery cage holding a plurality of batteries wherein, the barrel connection portion can form a shallow cylindrical protrusion receiving a shallow cylindrical depression formed on the second strand connector.

9. An LED illuminated pendant comprising: an LED lighted pendant element held by a first strand and a second strand; a battery housing forming a housing connector at a first end, the first strand attached to the battery housing, the first strand having a pair of electrical wires of positive and negative polarity disposed within: the second strand attached to the second strand connector that removably joins to the housing connector; a printed circuit board controlling LED activation according to a switch mode activated by a push switch; the battery housing holding a battery cage holding a plurality of batteries wherein, the printed circuit board allows multiple LED modes to allow rotation in mode selection from a first mode to a second mode to a third mode to an off mode.

10. An LED illuminated pendant comprising: an LED lighted pendant element held by a first strand and a second strand; a battery housing forming a housing connector at a first end, the first strand attached to the battery housing, the first strand having a pair of electrical wires of positive and negative polarity disposed within: the second strand attached to the second strand connector that removably joins to the housing connector; a printed circuit board controlling LED activation according to a switch mode activated by a push switch; the battery housing holding a battery cage holding a plurality of batteries wherein, the battery cage comprises a metal clip having a middle and a pair of ends secured around a plastic cylinder that has open top and bottom ends, wherein the metal clip secures the bottom of the plastic cylinder at its middle and the pair of ends extend along the side of the plastic cylinder to the top of the plastic cylinder, wherein the pair ends extend over the top of the plastic cylinder.

11. An LED illuminated pendant comprising: an LED lighted pendant element held by a first strand and a second strand; a battery housing forming a housing connector at a first end, the first strand attached to the battery housing, the first strand having a pair of electrical wires of positive and negative polarity disposed within; the second strand attached to the second strand connector that removably joins to the housing connector; a printed circuit board controlling LED activation according to a switch mode activated by a push switch; the battery housing holding a battery cage holding a plurality of batteries wherein, the lid secures to the barrel housing by a pair of opposing square steps that fit and lock into a pair of respective L shaped slots formed inside the barrel housing, wherein a spring attached to the lid pushes between the battery and lid biasing the lid in closed position.

* * * * *